US006173519B1

(12) United States Patent
Garrett

(10) Patent No.: US 6,173,519 B1
(45) Date of Patent: Jan. 16, 2001

(54) TOOL FOR INSTALLING / REMOVING MAGAZINE CATCH

(76) Inventor: Robert H. Garrett, 8191 Barwood Rd., Manassas, VA (US) 20111

( * ) Notice: Under 35 U.S.C. 154(b), the term of this patent shall be extended for 0 days.

(21) Appl. No.: 09/412,775

(22) Filed: Oct. 4, 1999

(51) Int. Cl.[7] ..... F41A 15/00

(52) U.S. Cl. ..... 42/90; 42/70.01

(58) Field of Search ..... 42/6, 90, 95, 96, 42/106, 71.01, 71.02; 102/502

(56) References Cited

U.S. PATENT DOCUMENTS

| | | | | |
|---|---|---|---|---|
| 1,489,677 | * | 4/1924 | Stampfli | 42/71.01 |
| 2,476,355 | * | 7/1949 | Brown | 42/6 |
| 3,564,949 | | 2/1971 | Hedrick . | |
| 3,564,950 | | 2/1971 | Jorczak . | |
| 3,939,590 | | 2/1976 | Musgrave . | |
| 4,483,060 | * | 11/1984 | Farrar et al. | 29/278 |
| 4,700,500 | | 10/1987 | Slappey, Jr. . | |
| 4,819,289 | | 4/1989 | Gibbs . | |
| 5,048,214 | * | 9/1991 | Cohen | 42/71.02 |
| 5,159,136 | * | 10/1992 | Marsh | 42/71.01 |
| 5,337,505 | | 8/1994 | Brown . | |
| 5,416,940 | * | 5/1995 | Bandera | 42/90 |
| 5,417,003 | | 5/1995 | Claveau . | |
| 5,880,398 | * | 3/1999 | Crilly et al. | 102/501 |

OTHER PUBLICATIONS

U. S. Marine Corps/ US Army TM 05538C–10/1A, p. 88.
US Army Technical Manual TM 9–1005–249–24&P, pp. 3–61.

* cited by examiner

*Primary Examiner*—Charles T. Jordan
*Assistant Examiner*—Michelle Thomson

(57) ABSTRACT

The present invention relates to a tool for the installation and removal of the magazine catch of automatic and/or semi-automatic firearms. In particular, a magazine catch which is transversely operable within the firearm like that of the M16A2 and M4 Carbine where the magazine catch button must be depressed sufficiently to allow for the rotation of the magazine catch for installation or removal. The tool enables the user to orient, insert, depress and hold the magazine catch button and to steady the firearm simultaneously with one hand. The tool is designed to limit the insertion of the magazine catch button so as to eliminate the damage caused to the magazine catch spring by over-insertion of the magazine catch button. The preferred embodiment is constructed of polymer to eliminate damage to the firearm and its parts. The design of the invention also serves to reduce discomfort and injury to the hand of the user caused by conventional tools or field expedients used to perform this task. The invention can also be configured to fit into the hollow cavity of the pistol grip where it is held in place by an interference fit, creating a storage space for various items. The invention is also provided with a storage insert which can be configured for various tasks.

17 Claims, 6 Drawing Sheets

TOOL FOR INSTALLING / REMOVING MAGAZINE CATCH

BACKGROUND

1. Field of Invention

The present invention relates to the field of tools used to install, remove and maintain the magazine catches of firearms.

2. Background of the Invention

The use of tools to install, remove and maintain the magazine catches of firearms is known. Most semi-automatic and automatic firearms are provided with a means to retain a detachable box magazine in order to efficiently reload the firearm. This retention means is most commonly referred to as a magazine catch or magazine release. The structure and function of magazine catches vary, but basically they require the user to push a button or lever in order to release the magazine from the firearm.

Some designs, like magazine catches found on the H&K G3 or MP5, require the use of a punch and hammer to remove a roll pin securing the magazine catch button to the shaft of the magazine catch. The components of these releases are not designed to be easily removed for cleaning and maintenance.

Others like the transversely operable catch found on the M16A2 and M4 Carbine rely on a threaded shaft to secure the catch to a threaded button. The button and catch are elongated and fit into similar elongated slots in the receiver. The elongated design of the components keep them from unscrewing when operating within their respective slots. A magazine catch spring provides tension to the button which, in turn, pulls the catch into contact with the magazine. In order to install or remove the catch, the button must be fully depressed within its slot and held in this position. With the button fully depressed, it is possible to rotate the catch for installation or removal. When installing the catch, the user rotates the assembly a sufficient number of revolutions clockwise and aligns the catch with its elongated slot. The button is then slowly released allowing the catch to come to rest. If the user fails to rotate the catch a sufficient number of times or rotates the catch too many times, the procedure must be repeated until the end of the shaft is generally flush with the depression surface of the magazine catch button.

In order to depress the magazine catch button sufficiently, some type of tool must be used as the slot is too small for the average human finger. Several types of tools and field expedients have been used to perform this task in the past.

3. Background—Discussion of Prior Art

The use of a metal punch is recommended in technical manuals as a tool to be used to depress the button for repair or maintenance. This is due to the fact that a punch may be readily found in an armorers tool kit or mechanics tool kit. The USMC/U.S. Army field manuals call for the use of the nose of a bullet or an issue metal cleaning rod section to be used to depress the magazine catch button to adjust the magazine catch. The magazine catch button of some firearms like the M16A2 and M4 are constructed of aluminum with a hard anodizing coating and can be scratched or damaged by the nose of a bullet, a steel punch or cleaning rod section. Use of the punch is awkward and can be painful as the punch is usually held in place with the palm of the hand. The same holds true for the use of the bullet. Due to the length of the bullet, punch and the cleaning rod section, the user is unable to use the hand holding the tool to steady the firearm. Since the opposite hand is being used to install and rotate the catch, the weapon has to be held by another individual or secured in a vise before attempting the installation procedure. Starting the button into its slot against the tension of the spring can also be quite difficult when using the smooth end of the punch or conical nose of a bullet. Often times the button slips and the punch scratches or burrs the exterior finish of the aluminum receiver. Live ammunition is only issued in combat situations and therefore cannot be used during peacetime operations and training.

Other field expedients have been used to accomplish the task of depressing the magazine catch button such as an unsharpened pencil or nylon punch. These expedients do not damage the parts but they are still awkward to use and cause considerable discomfort to the hand of the user. These punch-like expedients still have many of the same limitations as the steel punch.

Damage can also be caused to the magazine catch spring when a punch or similar tool is used to fully depress the magazine catch spring. When a coil spring is allowed to be compressed to a "solid" state (all coils touching) the spring takes a "set" weakening the spring and possibly causing magazine retention failure. Care must be taken to depress the spring only enough to install the catch and not to allow the spring to "go solid". It is virtually impossible to accomplish this metered depression of the magazine catch button without some limiting means that is incorporated into the tool.

Inventors have created several types of tools to maintain firearms like the M16A2 and M4 Carbine.

One invention, U.S. Pat. No. 4,819,289 to Gibbs, Apr. 11, 1989, is basically a combination tool designed to perform multiple adjustments and mechanical operations to a firearm and its accessories. While this tool could be used to perform the task of depressing the magazine catch button, it still has many of the disadvantages that are associated with the other prior art references previously discussed. The blade most suited to the task is of a narrow screwdriver configuration and is constructed of steel. The user would have difficulty starting the magazine catch button into the slot with this tool and its length would also call for the use of a vise or another individual to steady the weapon. This blade is also pivotally attached to its handle and lacking a locking feature. It is likely that the user would experience difficulty in keeping the blade extended to accomplish the task of depressing the magazine catch button. If the blade folded during the operation, damage to the firearm and components or loss of components would result. The blade also lacks a limiting means to protect the magazine catch spring from the damage caused by over insertion of the magazine catch button.

Another invention, U.S. Pat. No. 3,564,950 to Jorczak, Feb. 23, 1971, although specifically designed as a cartridge extraction device, could also be used to depress the magazine catch button. In this capacity the opposite end of the extractor claw would serve as a punch. All of the disadvantages discussed previously also apply to this expedient. Those being, damage to the firearm or parts due to steel construction, awkward use due to the tools length, a lack of a depression limiting means and discomfort or injury to the hand of the user from the extractor claw of the tool.

It should be clear to the reader that a tool that allows an individual to simultaneously hold a magazine catch button in a depressed state and steady the firearm with the same hand is of great necessity. It should also be clear that the tool should be made of a non-marring material, should not cause discomfort to the user and should be designed to aid in the alignment and insertion of the magazine catch button into the receiver. Lastly, it should be clear that the tool should be designed to limit the amount of insertion of the magazine catch button to protect against weakening of the magazine catch spring.

All of the other prior art references cited have one or more of the disadvantages previously discussed associated with their use -to accomplish the task of depressing the magazine catch button.

Objects and Advantages

One object of my invention is to provide a magazine installation and removal tool that is readily adaptable to a wide range of "NATO" firearms currently in use. The preferred embodiment of my invention will be constructed of a polymer, such as Delrin, making it a lightweight, non-corrosive and non-marring tool. Accordingly, one of the objects of my invention is to provide a tool that will not harm or damage the finish of the firearm or its parts. The preferred embodiment will also include a stop shelf for limiting the engagement of the ram on older firearms that are not fitted with a magazine catch button protective fence or rib. Accordingly, another object of my invention is to provide a tool that includes one or more limiting means to protect the magazine catch spring from damage caused by over insertion of the magazine catch button. Another object of my invention is to provide a tool that is comfortable to use and allows the user to simultaneously depress the magazine catch button and steady the firearm with the same hand. A further object of my invention is to provide a tool that enables the user, with one hand, to effortlessly align the magazine catch button and insert it into its slot.

Another disadvantage not previously discussed is that of storage of the tool itself. Firearms like the M16A2 are equipped with a storage area in the buttstock. Firearms like the M4, however, are fitted with a collapsible buttstock and have no provision for the storage of cleaning supplies and accessories. Yet a further object of my invention is to provide a tool that can be inserted and held in the hollow pistol grip of the firearm by an interference fit creating a storage area. This storage area could be used to store additional batteries for electronic scopes, small cleaning supplies, important folded documents or survival supplies. Some items to be stored could be susceptible to damage from water or could make noise if not secured in the storage space. It is a further object of my invention to provide a non-permanently attachable storage insert that can be constructed in various ways to accomplish various tasks. The tool would also be of a convenient size to fit in the storage area provided in firearms like the M16A2.

Further objects and advantages of my invention will become apparent from a consideration of the drawings and ensuing description.

BRIEF DESCRIPTION OF THE DRAWINGS

The present invention will now be described further by way of example, with reference to the accompanying drawings, in which.

REFERENCE NUMERALS IN DRAWINGS

Figure 1:
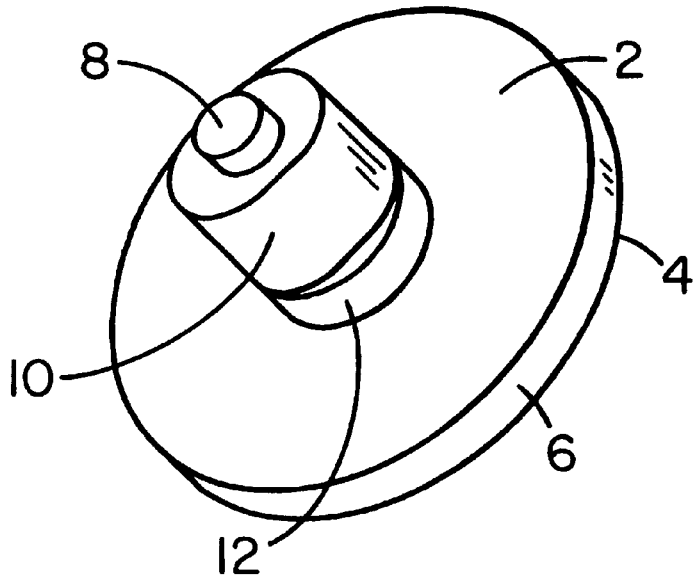
FIG. 1 is a perspective view of the preferred embodiment.

2 face
4 back
6 base
8 boss
10 ram
12 stop shelf
14 fence
16 lower receiver
18 thumb
20 index finger
22 magazine catch
24 shaft
26 threaded portion
27 end
28 through hole
29 threaded orifice
30 spring seat
32 magazine catch slot
34 elongated orifice
36 buttstock
38 magazine catch button
40 depression surface
42 magazine catch spring
44 magazine well
46 pistol grip
48 magazine
50 trigger guard
52 pistol grip opening
54 rear inner surface
56 front inner surface
58 hook and loop fastener
59 storage space
60 storage insert

DESCRIPTION OF THE PREFERRED EMBODIMENT—FIGS. 1 AND 3

Figure 3:
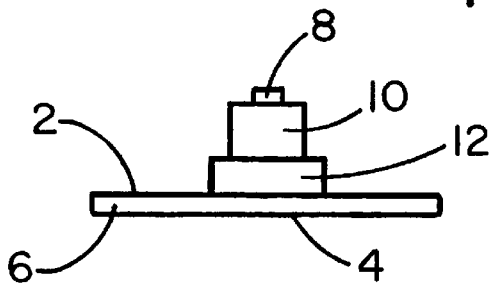
FIG. 3 is a side view of the preferred embodiment.

In FIG. 1 and FIG. 3 the preferred embodiment is shown having a depression pad or base 6 having a back 4 provided for depressing the tool and a face 2 for limiting engagement of the tool on firearms having a protective guard or fence around the magazine catch button. Base 6 is fixed to a limiting pad or stop shelf 12 provided to limit insertion of the tool into firearms not having a protective guard or fence around the magazine catch button. The diameter of stop shelf 12 must be large enough to limit insertion of the tool but must be small enough so as not to interfere with the abutment of face 2 with the protective guard or fence around the magazine catch button. The abutment of stop shelf 12 with the receiver and face 2 with the protective guard should be simultaneous and result in the proper depression of the magazine catch button to facilitate removal of the magazine catch while limiting the insertion of the magazine catch button to protect the magazine catch spring from damage. Stop shelf 12 is fixed to a shaft or ram 10 which can have the same contour as the magazine catch button to aid in aligning the magazine catch button for insertion into its slot in the lower receiver of the firearm. Ram 10 is provided with a stationing protrusion or boss 8 which is inserted into the threaded orifice of the magazine catch button to hold the button in place for ease of insertion into its slot in the lower receiver of the firearm. By positioning the threaded orifice of the magazine catch button over boss 8, aligning the contour of ram 10 with the contour of the magazine catch button and placing the aligned magazine catch button between the side of the index finger between the last joint and the end of the finger and the side of the middle finger at the last joint while placing the thumb of the same hand on back 4 of base 6, the magazine catch button is positioned properly for insertion into its slot in the lower receiver. Once the magazine catch button is started into its slot the index finger and middle finger are removed while maintaining pressure on the tool with the thumb placed on back 4 of base 6, the tool is further inserted until face 2 of base 6 abuts to the protective guard or fence around the magazine catch button and/or stop shelf 12 abuts to the lower receiver limiting the insertion of the magazine catch button and compression to the magazine catch spring to protect it from damage due to taking a "set" (weakening of a spring) by "going solid" (all coils touching). The height of boss 8 must be sufficient to aid in the alignment of the magazine catch button but must not interfere with the abutment of face 2 with the protective fence or stop shelf 12 with the receiver when the threaded shaft of the magazine catch is fully threaded into the magazine catch button and the end of the magazine catch shaft is generally flush with the depression surface of the magazine catch button. Excessive height of boss 8 may cause the magazine catch button to compress the magazine catch spring to a "solid" state when boss 8 is displaced by the end of the magazine catch shaft when it is fully screwed into the magazine catch button and generally flush with the depression surface of the magazine catch button.

Operation—FIGS. 4–7

Figure 4:
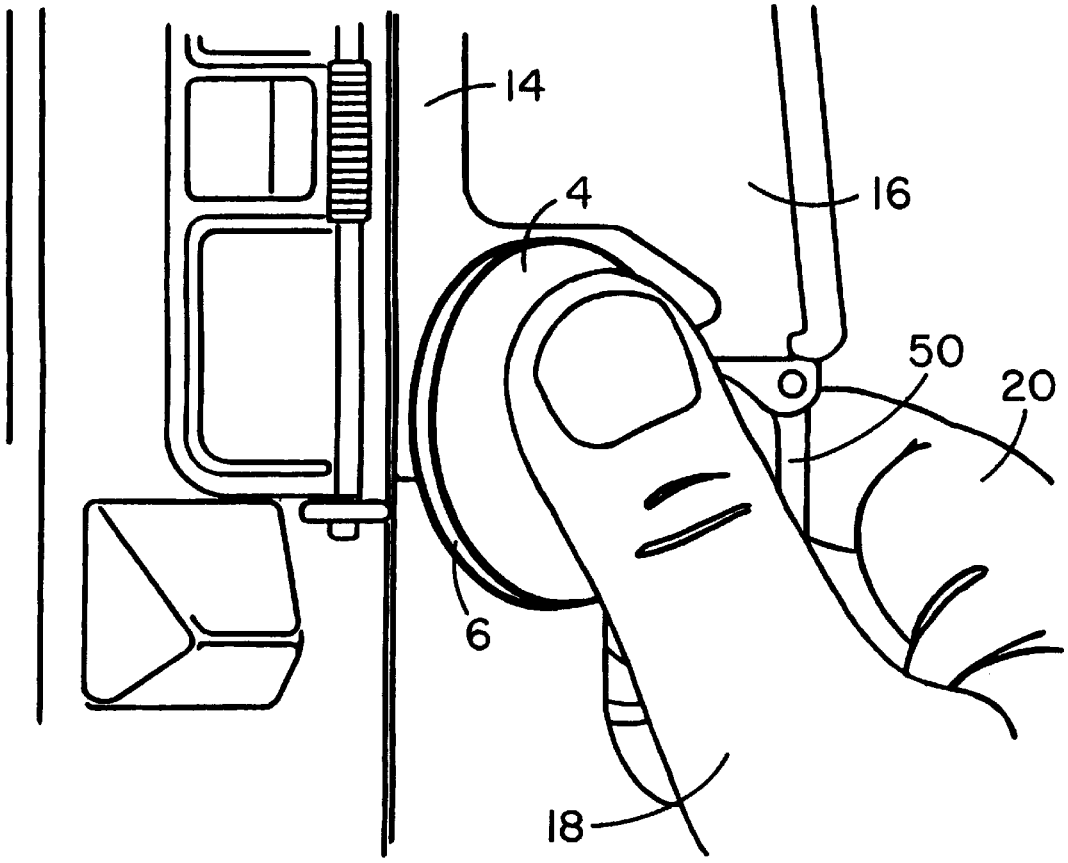
FIG. 4 is a perspective view showing the preferred embodiment fully inserted into the firearm and being held in place with the thumb of one hand.

FIG. 4 shows base 6 abutting fence 14 of a lower receiver 16. Base 6 is being held in place by a thumb 18 of the inserting hand while an index finger 20 of the same inserting hand is placed around a trigger guard 50 of lower receiver 16 to aid in maintaining pressure on base 6 and steady the firearm.

Figure 5:
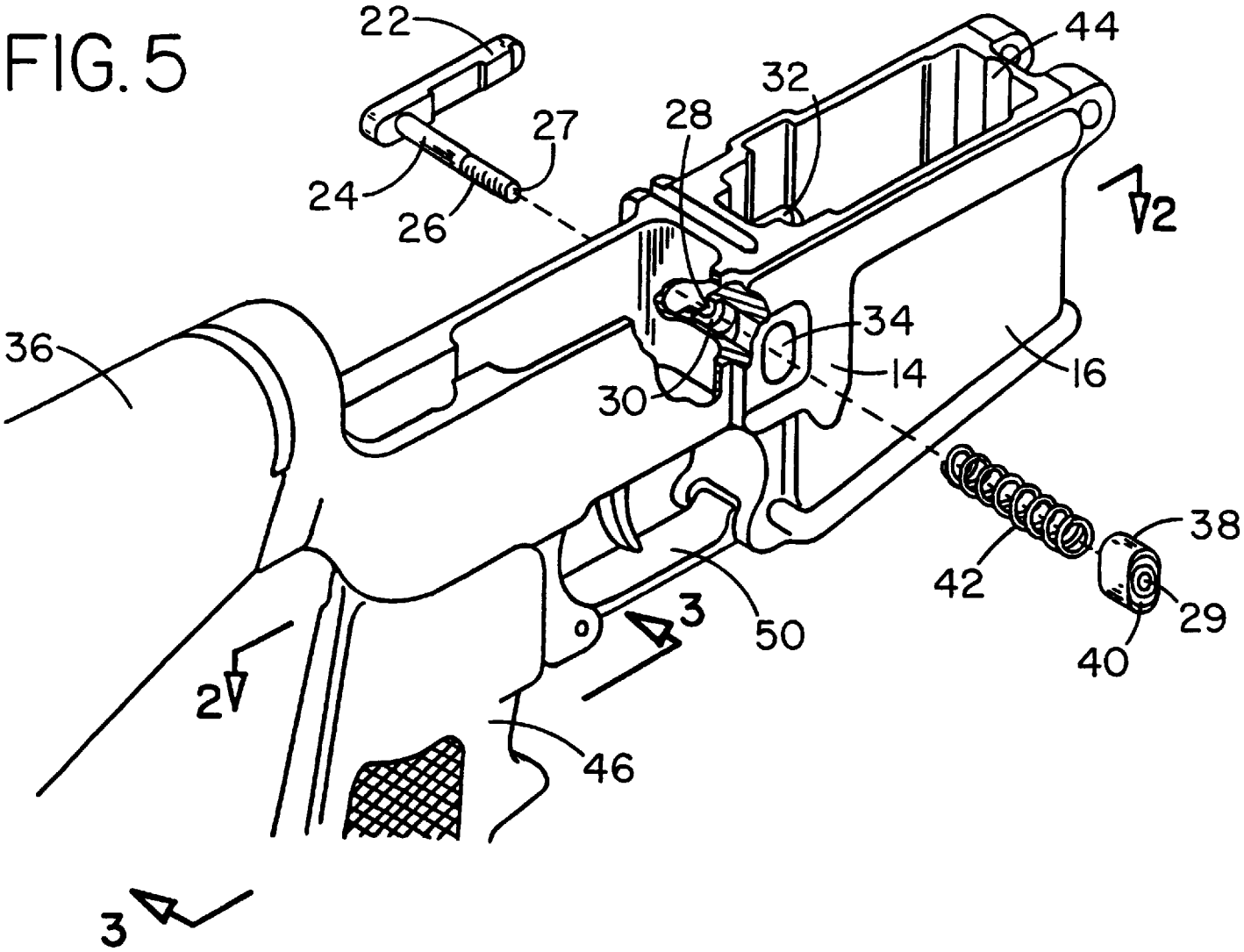
FIG. 5 is a perspective view of the firearm showing the relationship of the components.

FIG. 5 shows the relationship of the components where lower receiver 16 is fitted with a buttstock 36, a pistol grip 46, trigger guard 50, and incorporates a magazine well 44 for insertion of a magazine and fence 14 to protect a magazine catch button 38 from accidental depression. A magazine catch spring 42 is inserted into an elongated orifice 34 and comes to rest on a spring seat 30. Magazine catch button 38 contacts extended magazine catch spring 42 and compresses magazine catch spring 42 while being inserted into elongated orifice 34 and is held in place just short of full compression of magazine catch spring 42. A threaded portion 26 of a shaft 24 of a magazine catch 22 is guided through a through hole 28 of lower receiver 16. Threaded portion 26 is screwed into a threaded orifice 29 of magazine catch button 38 until an end 27 of shaft 24 of magazine catch 22 is generally flush with a depression surface 40 of magazine catch button 38. Magazine catch 22 is then aligned with a magazine catch slot 32 of lower receiver 16 and magazine catch button 38 is slowly released until magazine catch 22 comes to rest in magazine catch slot 32.

Figure 6:
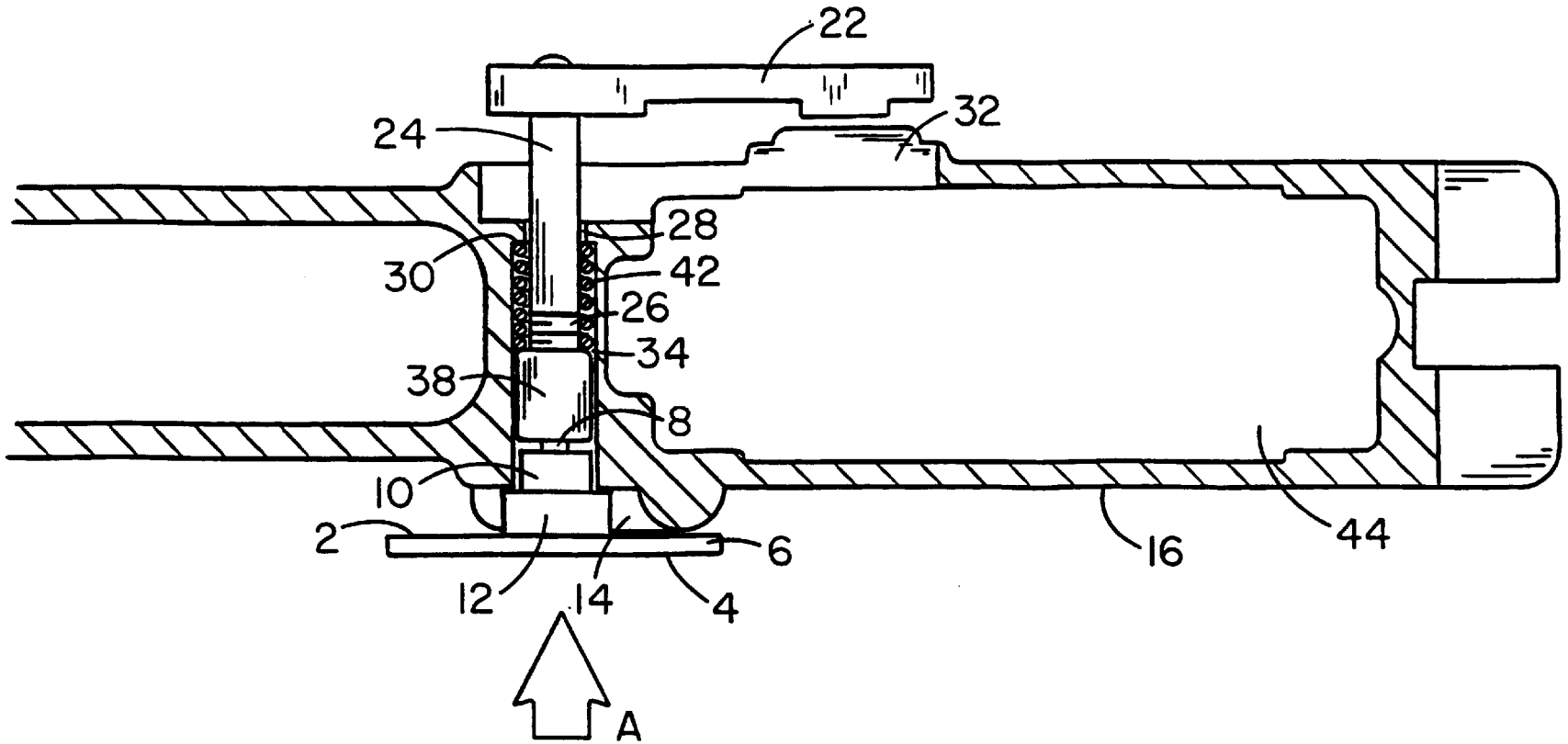
FIG. 6 is a partial longitudinal cross-section view taken along line 2—2 of FIG. 5, showing the tool fully seated against the fence of the receiver of the firearm to facilitate rotation of the displaced magazine catch.

FIG. 6 shows the preferred embodiment inserted into lower receiver 16. Force is applied to back 4 of base 6 in the direction of arrow "A" until face 2 of base 6 and stop shelf 12 abut fence 14 and lower receiver 16 respectively and simultaneously and ram 10 and boss 8 station magazine catch button 38 properly for installation or removal of magazine catch 22. Boss 8 has been displaced by fully inserted shaft 24 of magazine catch 22 and magazine catch spring 42 is not fully depressed. Magazine catch 22 is fully clear of magazine catch slot 32 allowing for clockwise or counterclockwise rotation of magazine catch 22 for installation or removal.

Figure 7:
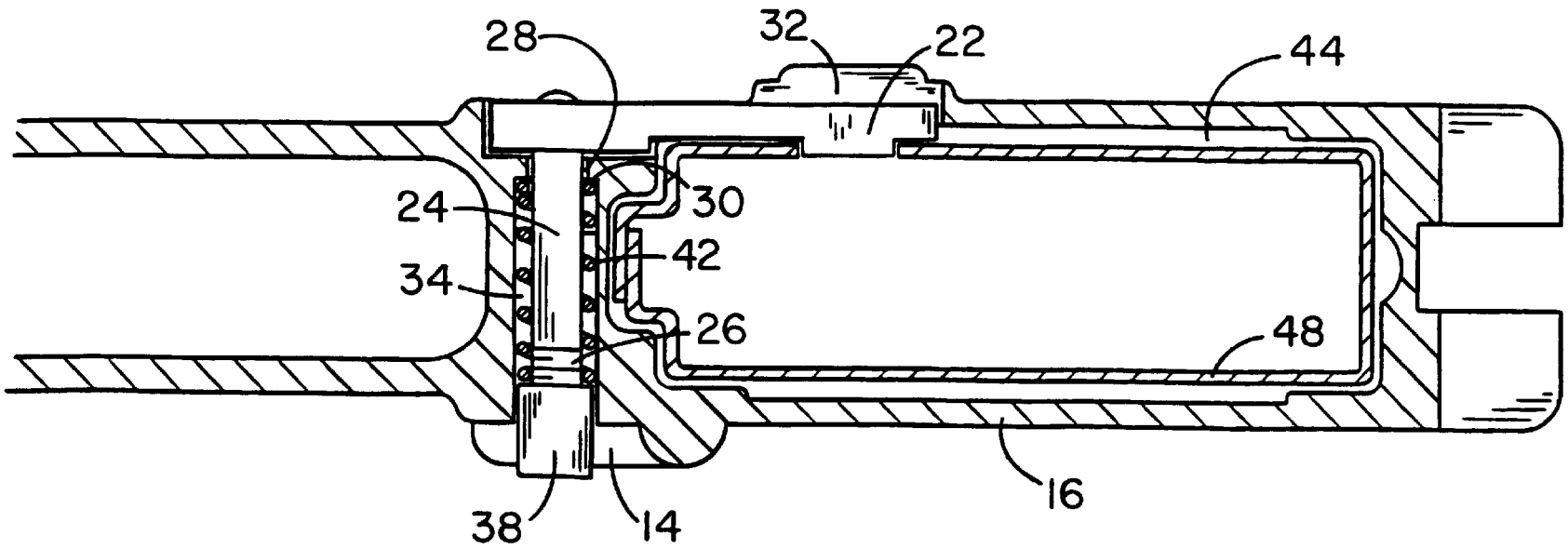
FIG. 7 is a partial longitudinal cross-section view taken along line 2—2 of FIG. 5, showing the magazine catch fully engaged with the magazine catch button and at rest.

FIG. 7 shows the completed installation where magazine catch 22 is at rest in magazine catch slot 32 and engaged with a magazine 48 inserted in magazine well 44 of lower receiver 16.

While the description above contains many specificities, these should not be construed as limitations on the scope of the invention, but rather as an exemplification of one preferred embodiment thereof. Many other variations are possible.

Figure 2:
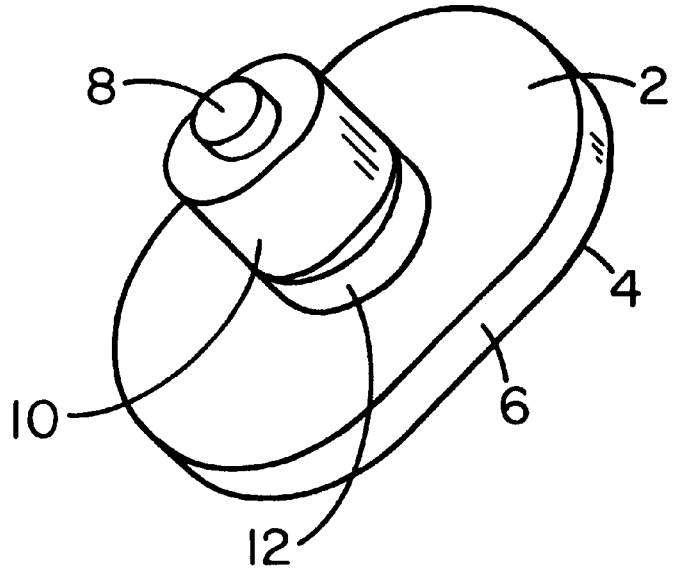
FIG. 2 is a perspective view of an alternative embodiment.
Figure 8:
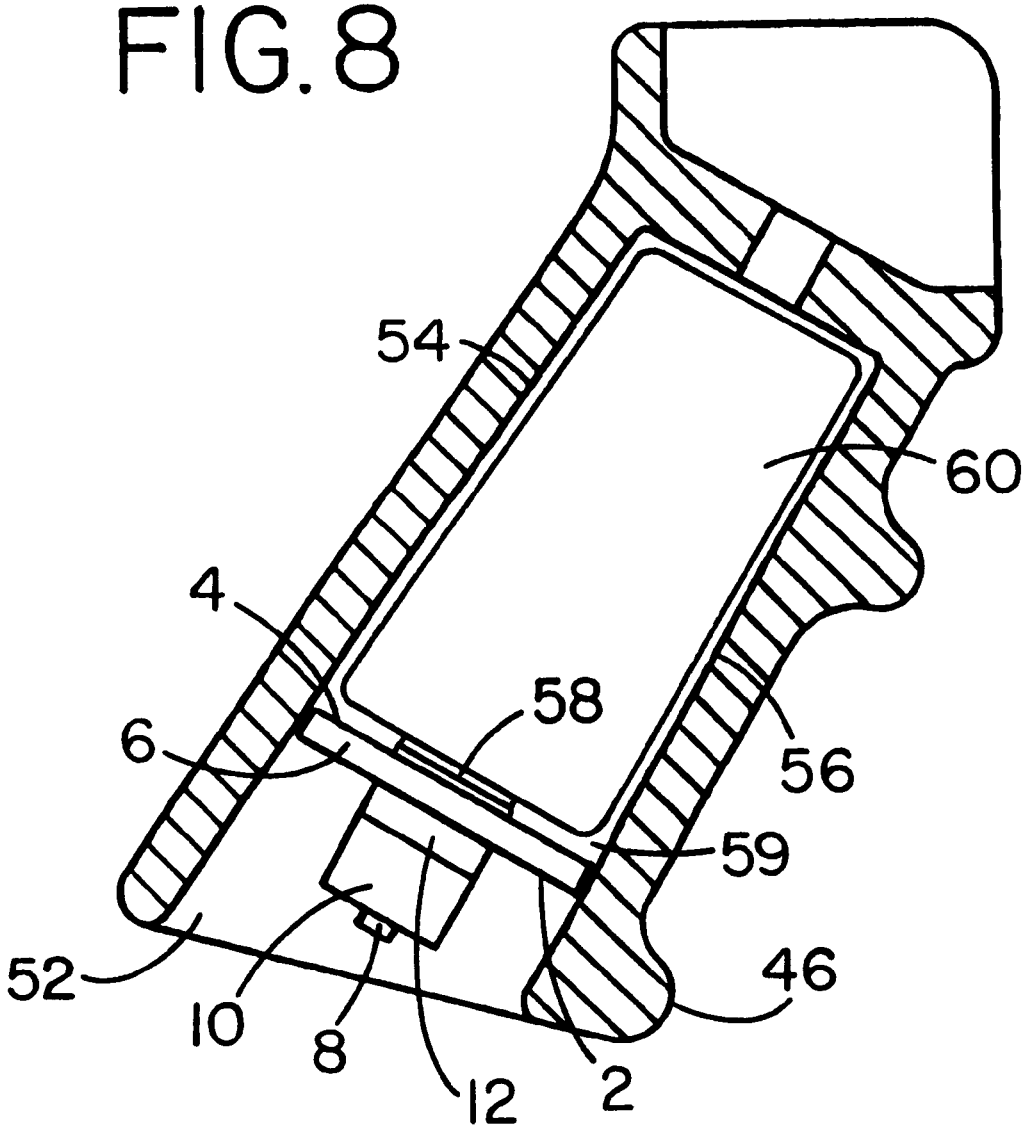
FIG. 8 is a partial cross-section view taken along line 3—3 of FIG. 5, showing an alternative embodiment of the tool installed in the opening of the pistol grip for storage.

Additional Ramifications—FIGS. 2 AND 8

For example, the alternative embodiment shown in FIG. 2. This embodiment has a narrow width making it more compact and easier to store. The outside contour and slight taper of base 6 allow it to be stored in pistol grip 46 of lower receiver 16, depicted in FIG. 5, by "interference fit". This interference fit is shown in FIG.8 where an alternative embodiment of the tool is placed in a pistol grip opening 52 of pistol grip 46 and creates a storage space 59 within pistol grip 46 where cleaning patches, spare electronic scope batteries or other items can be stored. Base 6 is inserted with back 4 facing storage space 59 and is evenly inserted until an interference fit is achieved evenly with a rear inner surface 54 and a front inner surface 56. At this point boss 8, ram 10 and stop shelf 12 are all contained within pistol grip 46. Removal of this alternative embodiment is achieved by using the thumb and index finger to pull on ram 10 until base 6 no longer interferes with rear inner surface 54 and front inner surface 56. A storage insert 60 is non-permanently attached to base 6 by means of a hook and loop fastener 58 also known as Velcro. Storage insert 60 can be constructed of a hard foam with special spaces provided for the storage of batteries and other accessories to protect the items from damage and reduce the noise caused by loose parts.

Storage insert 60 can also be constructed of a nylon woven material in the form of an envelope with a flap type top to store cleaning supplies. Storage insert 60 may also be constructed of a thick polymer film with a "water-tight" squeeze zipper closure to create a water-proof storage container for items susceptible to water damage. Storage insert 60 could also be constructed from a thick, rigid polymer enclosed on its sides and base and open on the top for the storage of items that are not susceptible to water damage. Removal of storage insert 60 is achieved simultaneously with the removal of the alternative embodiment by using the thumb and index finger to pull on ram 10 until base 6 no longer interferes with rear inner surface 54 and front inner surface 56. An auxiliary loop constructed from nylon parachute cord can be attached to the base of storage insert 60 to aid in its removal from storage space 59 in the event that the force exerted on hook and loop fastener 58 is too great and storage insert 60 is separated from base 6 and storage insert 60 remains lodged in storage space 59. As previously stated, in the case of the M4 Carbine fitted with a collapsible stock, the lack of a fixed stock with storage compartment limits the items that can be stored within the firearm.

SUMMARY

It should, therefore, be clear to the reader that the structure of my invention will enable individuals to remove and install the magazine catch of firearms quickly and efficiently and eliminate the damage to the components caused by the use of conventional tools such as a punch and field expedients such as a bullet and cleaning rod section. Furthermore, the structure of my invention has additional advantages in that;

- it is readily adaptable to a wide range of "NATO" firearms currently in production;
- it will effectively work on firearms that are fitted with a magazine catch button protective guard or fence as well as those firearms that do not have such a guard or fence;
- it can be constructed with a boss and can have a ram contour that make retention of the magazine catch button and insertion of the button into the receiver a much more efficient one hand operation;
- it may be comfortably used and allow the user to orient, depress and hold the magazine button and steady the firearm simultaneously with one hand;
- it can be constructed of a non-marring polymer to eliminate damage to the firearm and its components;
- it can be configured to eliminate the damage caused to the magazine catch spring from over insertion of the magazine catch button;
- alternative embodiments can be constructed to fit into and provide storage space in the hollow cavity of the pistol grip and be held in place by an interference fit;
- alternative embodiments can be non-permanently attached to a storage insert of various configurations.

Accordingly, the scope of my invention should be determined not by the embodiments illustrated but by the appended claims and their legal equivalents.

I claim:

1. A tool for the installation and removal of a magazine catch of a firearm, said magazine catch having a magazine catch button for depression thereof within said firearm, said firearm having a protective fence adjacent the magazine catch button, said tool comprising:

a planar base;

a shaft projecting from said planar base, said shaft being of a predetermined fixed length to limit insertion of the magazine catch button when said planar base contacts the protective fence, and;

a boss projecting from said shaft for insertion into a threaded orifice of the magazine catch button to provide for ease of alignment and insertion of the magazine catch button to provide enhanced ease of alignment and insertion of said magazine catch button into the firearm.

2. A tool according to claim 1, wherein said shaft includes a limiting shelf that simultaneously contacts an outer surface of said firearm when said planar base contacts said protective fence.

3. A tool according to claim 2, wherein said tool is constructed entirely of a rigid polymer.

4. A tool according to claim 1, wherein said planar base is configured to fit into a hollow cavity of a pistol grip and be held in place by an interference fit.

5. A tool according to claim 4, whereby said interference fit creates a storage space.

6. A tool according to claim 5, wherein a storage insert is provided to protect items stored in said storage space.

7. A tool according to claim 6, wherein said storage insert is constructed of a nylon mesh material and includes a sealed bottom, sealed sides and an open top.

8. A tool according to claim 7, wherein said storage insert is provided with a closeable top flap.

9. A tool according to claim 6, wherein said storage insert is constructed of a hard foam with spaces provided for various items.

10. A tool according to claim 6, wherein said storage insert is constructed of a thick polymer film sealed on all sides having a squeeze zipper closure at its top to create a water-proof storage container for items susceptible to water damage.

11. A tool according to claim 6, wherein said storage insert includes a bottom, a plurality of sides and a top and is constructed of a rigid polymer, said storage insert being enclosed on said bottom, said sides and said top is open.

12. A tool according to claim 6, wherein said storage insert has at least one of a loop and a cord attached to its base.

13. A tool according to claim 6, wherein said storage insert is attached to said tool by a readily dissociable fastener having numerous, protruding, unitary filaments randomly interlocking with, and simultaneously moving towards, mating structure.

14. A tool according to according to claim 4, wherein said tool is constructed entirely of a rigid polymer.

15. A tool according to according to claim 1, wherein said tool is constructed entirely of a rigid polymer.

16. A tool for the installation and removal of a magazine catch of a firearm, said magazine catch having a magazine catch button for depression thereof within said firearm, said firearm having a receiver body portion adjacent the magazine catch button, said tool comprising:

a planar base;

a shaft projecting from said planar base, said shaft including a limiting shelf projecting radially away therefrom, said shaft being formed with a predetermined fixed length to limit insertion of the magazine catch button when said limiting shelf contacts the receiver body; and a boss projecting from said shaft for insertion into a threaded orifice of the magazine catch button to provide for ease of alignment and insertion of the magazine catch button to provide enhanced ease of alignment and insertion of said magazine catch button into the firearm.

17. A tool according to claim 16, wherein said tool is formed from a rigid polymer.

* * * * *